United States Patent [19]

Friedman

[11] 4,411,364

[45] Oct. 25, 1983

[54] SKIN-PACKAGED POUCHES OF THE RETORT OR LIKE TYPE

[75] Inventor: Davide R. Friedman, Hanover Park, Ill.

[73] Assignee: Stone Container Corporation, Chicago, Ill.

[21] Appl. No.: 340,802

[22] Filed: Jan. 19, 1982

[51] Int. Cl.[3] ..... B65D 73/00

[52] U.S. Cl. ..... 206/466; 206/497; 206/524.8; 426/113

[58] Field of Search ..... 206/461, 466, 465, 469, 206/470, 471, 477, 478, 45.33, 45.19, 497, 524.8, 829; 426/106, 124, 129, 396, 410, 110, 112, 113, 114, 118; 229/55

[56] References Cited

U.S. PATENT DOCUMENTS

| | | | |
|---|---|---|---|
| Re. 25,466 | 10/1963 | Kostur | 53/509 |
| 2,124,324 | 7/1938 | Weeks | 206/466 |
| 2,833,402 | 5/1958 | Lefebvre | 206/466 |
| 2,923,401 | 2/1960 | Hagar | 206/45.33 |
| 3,293,048 | 12/1966 | Kitterman | 426/124 |
| 4,125,633 | 11/1978 | Vander Lugt, Jr. | 426/124 |

FOREIGN PATENT DOCUMENTS

| | | | |
|---|---|---|---|
| 2209355 | 6/1974 | France | 206/461 |

*Primary Examiner*—George E. Lowrance
*Assistant Examiner*—Jimmy G. Foster
*Attorney, Agent, or Firm*—Silverman, Cass & Singer, Ltd.

[57] ABSTRACT

A skin-packaged pouch of the retort or like type which includes a planar subtrate or card having the pouch immobilized on a medial body portion of the substrate by means of a plastic film laminated to the substrate overlying and surrounding the pouch to form the skin-packaged pouch. The pouch is immobilized on the substrate with portions of the substrate extending on all sides beyond the marginal edges of the pouch. In this manner, the normally fragile and frangible pouches with their lading can be efficiently handled, loaded for shipment in shipping cartons and stacked in such shipping cartons without damaging, adversely flexing or rupturing the seal of the pouch during transport thereof.

Modified embodiments of the invention include a plurality of like skin-packaged pouches interconnected in elongated strip assemblies in which the individual pouches are separated by fold or score lines in the substrate which enable selective folding of the elongated strip assemblies for convenient, efficient and effective storage in shipping cartons with the individual pouches adequately protected against damage and inadvertent rupture of the seal thereof. Individual skin-packaged pouches can be severed from the strip assembly, as needed.

Another modified embodiment includes the substrate card having scored or folded extensions advantageously located to overly the individual pouch to further restrain and/or support the same.

7 Claims, 15 Drawing Figures

FIG. 13
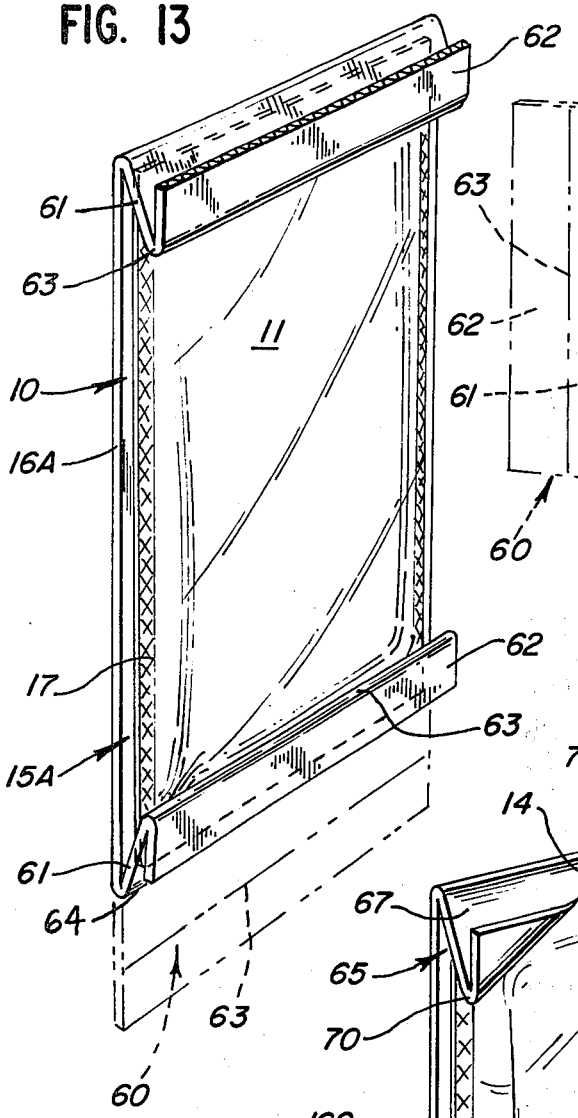
FIG. 14
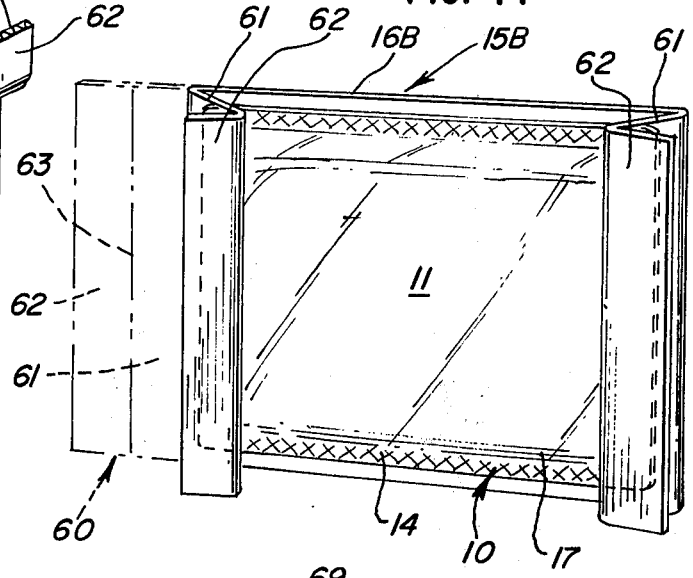
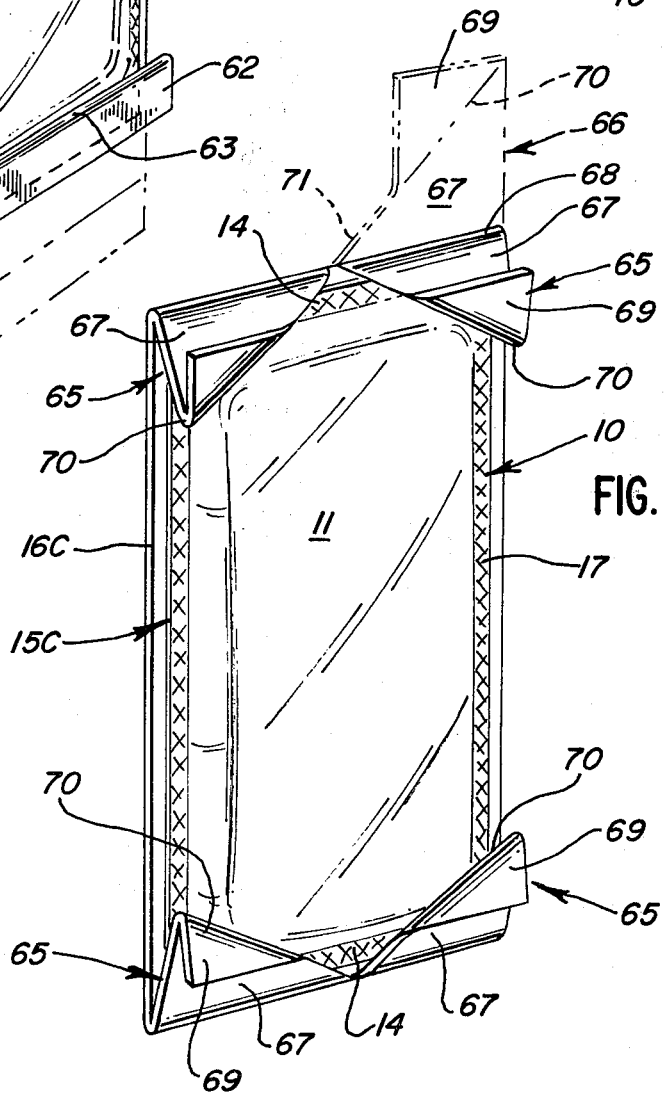
FIG. 15

SKIN-PACKAGED POUCHES OF THE RETORT OR LIKE TYPE

BACKGROUND OF THE INVENTION

This invention relates generally to packaging of normally fragile and frangible pouches and more particularly, relates to a novel package product comprising a skin-packaged pouch of the retort or like type fabricated by conventional skin packaging techniques to realize unexpected, desired shipping advantages.

A "retort pouch" as used herein consists of layers of metal and plastic film combinations or metalized films or sheets which have been bonded together along marginal edges thereof by thermal sealing together of said marginal edges to seal a product therein. The metal/-plastic combinations may comprise polyester film or polyethylene or polypropylene films laminated together into a sandwich with aluminum foil therebetween. Such a pouch containing a product, such as food, which requires processing can be so treated in a retort vessel while the product is encased in the pouch. Thus, a food product which requires cooking can be packaged in a retort pouch and cooked thereafter in the same manner as a similar food product packaged in the conventional tin can. Such pouches normally are fragile and easily ruptured.

The use of tin cans for packaging of processed foods can be considered universally accepted and commercialized in this country. Tin cans have considerably more bulk than pouches and withstand harsher handling conditions then a pouch. Such a tin can inherently has greater stacking strength than a pouch. Further, the seal afforded by a tin can is not easily ruptured by handling and stacking of the tin cans. These desirable features of tin can storage of processed foods, liquids, medicinal products or the like are not available from an ordinary retort pouch containing such a product.

For instance, the seal afforded by marginal thermal sealing of the films or sheets forming the pouch will not withstand the same pressures as will a tin can. A pouch has little, if any, stacking strength. The films or sheets are so flexible as to encourage cracking of the pouch during handling of the pouches and especially in case of shipping such pouches in shipping cartons. For instance, merely randomly bulk packaging of such retort pouches in a shipping container encourages occurrence of such adverse damage to such retort pouches as the shipping cartons are tossed about during transport. Consequently, tin cans have been more universally used for packaging of food products, semi-solids and liquids which otherwise might be adequately packaged in retort pouches where safe handling of retort packages can be assured during shipping thereof.

The obvious advantages derived from use of retort pouches include reduced cost of the pouch as compared to a tin can and reduced weight and bulk thereof for more economical shipment. There has been some recognized use of retort pouches for packaging of food liquids and medicinal products in foreign countries and in special instances where such products are supplied to military personnel. However, it is generally recognized that retort pouches have not been more universally commercialized in this country for packaging of liquids, semi-solids, food and medicinal products or the like which exhibit a so-called "wave action" inside of the pouch during handling thereof. Such "wave action" results in forces exerted from interior of the pouch against the marginally sealed edges of the pouch tending to separate said edges.

The recited disadvantages of using retort pouches for packaging of products exhibiting such "wave action" in the pouch are avoided by means of the herein invention which effectively immobilizes the retort pouch on a desirably rigid substrate by means of conventional skin-packaging techniques. The inventor herein is not aware of any prior art teaching the use of conventional skin packaging techniques for avoiding such heretofore recognized disadvantages of retort pouch packaging of such products and thereby enjoy the recognized advantages of retort pouch packaging as compared to tin can packaging of such products.

Although particularly notable advantages have been derived from application of the invention to skin packaging of retort pouches, such advantages may also be derived from such packaging of hot packs, asceptic packages and the like.

It has been known to employ shrink-packaging techniques for immobilizing rigid or contoured products on a tray. In shrink-packaging, the tray with products thereon usually is passed through a heat tunnel at which time a layer of thermoplastic film is softened to wrap around the tray and products. This process is different from the skin-packaging process which employs a vacuum draw to suck the softened film into tight engagement down on the products and substrate. Such tight engagement of the film over the skin-package product is not achieved using shrink packaging techniques. Blister packaging also is not suitable for anchoring a pouch on a flat substrate.

SUMMARY OF THE INVENTION

The invention comprises a skin-packaged pouch in which the pouch having the product encased therein is effectively immobilized on the medial body portion of a substrate or card such that the substrate has marginal portions thereof extending laterally beyond the pouch on all sides thereof. Such laterally extending portions cooperate to contribute stacking and impact strength to the pouch which was heretofore unavailable from the pouch standing alone. Further, by so immobilizing the pouch on the substrate, the marginal thermal sealed edges of the pouch are retained against the adjacent surface of the substrate by the film forming the skin of the package. As a result of such physical retention of the pouches sealed edges pressed against the substrate, rupturing of the sealed edges of the pouch by wave action of the product in the pouch is resisted. Also, flexing of the pouch is prevented sufficiently to prevent cracking of the film of the pouch.

The plastic film used in the skin packaging process reinforces the heat-sealed strength of the pouch to eliminate or minimize the possibility of seal leaks or blow outs due to hydraulic pressure from lading movement and shock in the shipping and distribution cycle of the product. The skin-packaged pouch provides added protection to special valves and spouts that might be used in medicinal or food product applications by rigidly holding such special contours against the substrate and preventing cracking, leakage and failure in operation of such special contours and shapes by immobilizing the same against the substrate.

The substrate not only offers rigidity and physical support to the retort pouch but also provides a printing surface for instructional information as well as graphics for promoting the retort pouch product.

One embodiment of the invention includes forming a series or an assembly of interconnected skin-packaged retort pouches which can be selectively folded and thereafter intermeshed with a like folded assembly, if desired, for storing in shipping cartons. Another assembly of interconnected skin-packaged retort pouches can be selectively folded without the intermeshing capability but with comparable advantages deriving from the assembly.

Additional embodiments include single or multiple package assemblies which includes folded over or scored panel areas located at ends, sides or corners of the substrate which can cooperate with the film skin to restrain and reinforce said pouches and resist hydraulic pressure and shock encountered during package handling in the market distribution cycle.

BRIEF DESCRIPTION OF THE DRAWINGS

FIG. 13 is a perspective view of another modified embodiment of the invention having folded-over protective substrate flanges at opposite ends of the package.

FIG. 14 is a perspective view of another modified embodiment of the invention with folded-over protective flanges.

FIG. 15 is a perspective view of still another modified embodiment of the invention having folded-over protective flanges.

DESCRIPTION OF EMBODIMENTS OF THE INVENTION

Figure 1:
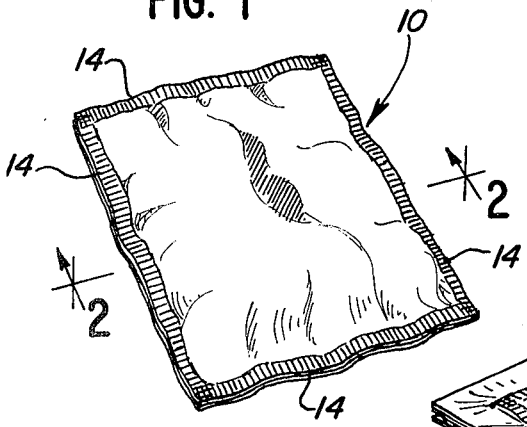
FIG. 1 is a perspective view of a representative retort pouch having a product sealed therein.
Figure 2:
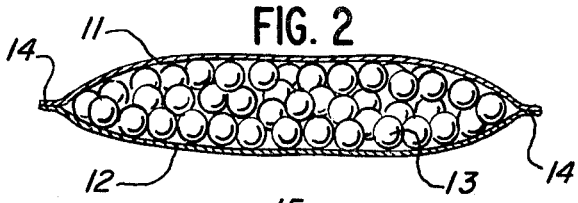
FIG. 2 is a cross-sectional view taken through said pouch along the line 2—2 of FIG. 1 and in the general direction indicated.

Referring to FIG. 1, a conventional retort pouch is designated generally by the reference character 10. Pouch 10 is comprised of a pair of substantially rectilinear sheets 11, 12 encasing a product 13 between the thermally sealed marginal edges 14 thereof. As seen in FIG. 2, marginal edges 14 have been fused together to effect sealing of the product 13 therein. The sheets 11, 12 may comprise a laminate assembly of plastic, an intermediate metal foil layer such as aluminum foil, and a second plastic film layer, such as, polypropylene. The product 13 may be liquid or semi-solid in character or a meat product, for instance, which would be somewhat solid. Retort pouch 10 permits the product 13 to be processed after it is packaged in the pouch. Such treatment would be desirable, for instance, in the case of a food product which must be cooked or a product which must be subjected to heat inside of the pouch. It will be appreciated that sheets 11, 12 are semi-flexible in character and, therefore, subject to cracking, if handled unduly harshly.

The nature of product 13 is such that it can shift or flow between opposing crimped marginal edges to create a so-called "wave action" on the interior of the pouch. Such wave action in the direction of the crimped marginal edges 14 can rupture the seal between such edges if sufficiently strong. Further apparent is the fact that retort pouch 10, as illustrated, has no stacking strength and without further protection during shipment of a plurality of such pouches in a shipping carton, is fragile and frangible by nature. Obviously, if the pouch cracks or the marginal edge seals are ruptured, the packaged product 13 will be contaminated or damaged beyond use. This would be evident in the case of a food product or a medicinal product, for instance.

Figure 3:
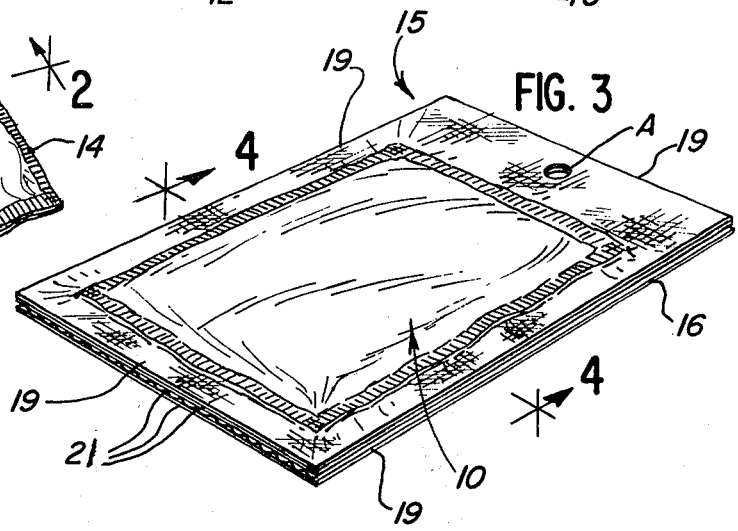
FIG. 3 is a perspective view of the skin-packaged retort pouch embodying the invention.

Referring to FIG. 3, there is illustrated a skin-packaged retort pouch in accordance with the invention which is designated generally by the reference character 15. The retort pouch 10 has been immobilized on a substrate or card 16 by means of a plastic skin or film 17 better seen in FIG. 4. The pouch 10 is supported on the medial body portion 18 of the substrate 16 such that substrate 16 has laterally extending portions 19 protruding beyond the marginal edges 14 of the pouch on all sides thereof. Such marginal portions 19 function as protruding flanges substantially rigid in the plane thereof and serve to prevent contact with the marginal seals 14 of the retort pouch along the plane of the substrate 16.

Figure 4:
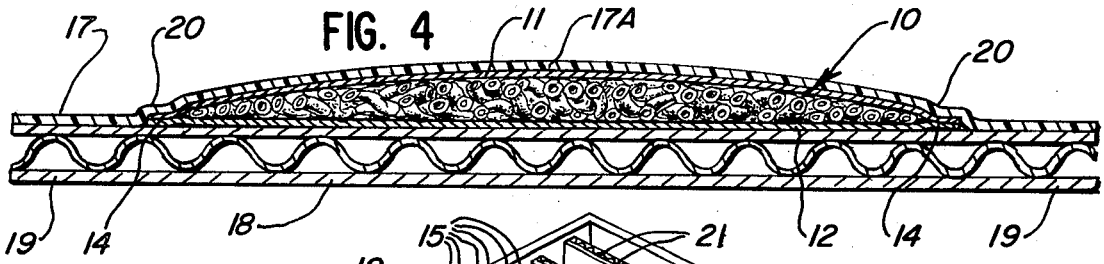
FIG. 4 is a sectional view taken along the line 4—4 of FIG. 3 and in the general direction indicated.

Referring to FIG. 4, it will be noted that the skin or film 17 is laminated to the marginal flange-like portions 19 and tightly engage over the edges 14 of the pouch as indicated at 20. As a result, the marginal edges 14 actually are pressed or forced against the substrate body portion 18 on all sides of the pouch so that the pouch is effectively immobilized on the body portion 18. Further, by reason of the force exerted by the film 17 against marginal edges 14 at locations 20, any force exerted against marginal seals 14 from the interior of the retort pouch by reason of wave action derived from movement of product 13 is resisted so as to assure that the marginal seals 14 will not be ruptured. Further, flexing of the sheet 11 is substantially prevented by the film segment 17A and flexing of sheets 12 is substantially prevented by the rigid medial body portion 18 of the substrate. In this manner, all of the disadvantages of the retort pouch per se for handling and shipment of liquids, semi-solid and solid products are avoided because of the additional support functions of the substrate 16.

The substrate 16 may consist of a suitable paperboard product such as corrugated or chipboard. The skin or films 17 would be comprised of a suitable thermoplastic sheet material on which can be heat-softened and vacuum drawn onto the substrate 16 and adhesively secured thereto in a conventional manner. As seen in FIG. 3, an aperture A can be stuck through a marginal flange 19 which will enable a package 15 to be hung from a display rack in a well known manner. Further, it may be noted that the flutes 21 of the substrate can be selectively arranged to extend along the length of the package for stacking strength purposes.

Figure 5:
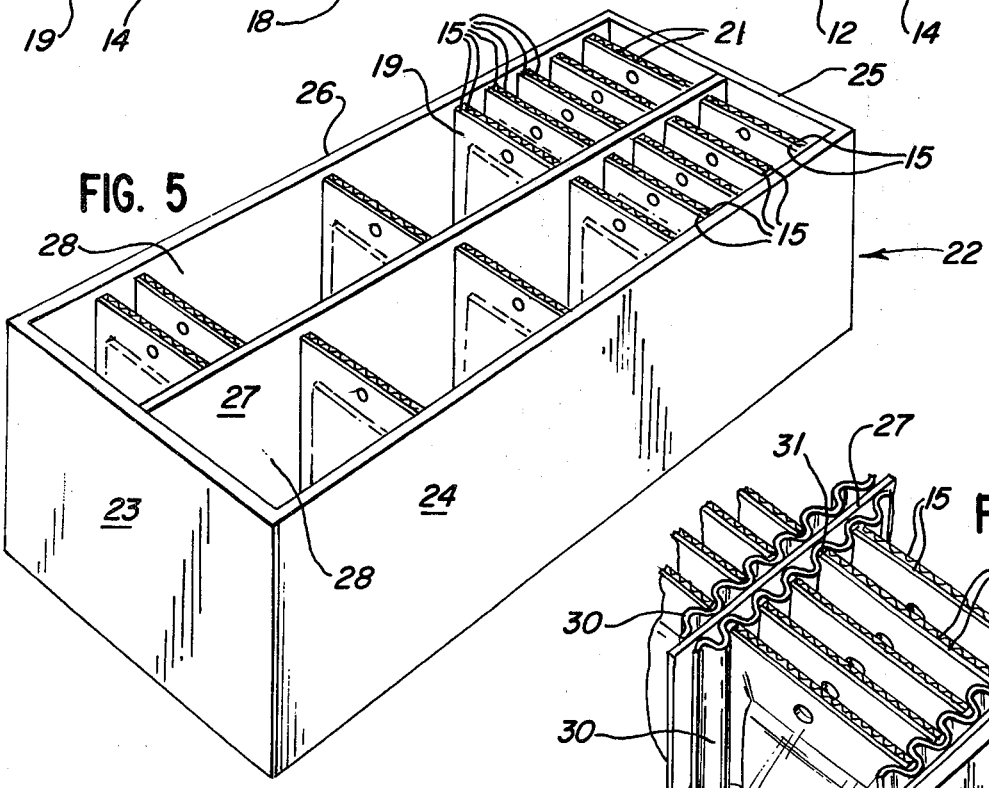
FIG. 5 is a perspective view of a tray formation representing a shipping carton having a plurality of skin-packaged retort pouches stacked therein for illustrative purposes. The tray or carton is not fully loaded.

Referring now to FIG. 5, there is illustrated an exemplary shipping carton 22. The entire carton is not illustrated for reasons of brevity. The carton has exterior supporting walls 23, 24, 25 and 26 and a partition wall 27 extending the length of the carton 22 parallel to and equally spaced from the walls 24, 26. Thus, a pair of compartments 28 is provided on opposite sides of partition wall 27 in cooperation with walls 24 and 27, respectively. The compartments 28 are closed at opposite ends thereof by walls 23, 25. The bottom wall of the carton or tray 22 is not seen in FIG. 5. A plurality of skin packaged pouches 15 are illustrated standing on end in the compartments 28. The compartments 28 are not completely filled with packages 15, as can be readily appreciated. In the vicinity of wall 25, it will be seen that the packages 15 have been stacked back-to-back. The marginal flanges 19 are engaged against adjacent walls of the compartments 28 in which packages 15 are loaded. Contact with the retort pouch 10 itself is avoided by reason of the marginal flanges 19 of the substrate so situated in compartments 28. When the compartments 28 are fully loaded, the packages 15 are completely immobilized in the compartments with the pouches 10 safely protected against inadvertent contact therewith.

Figure 6:
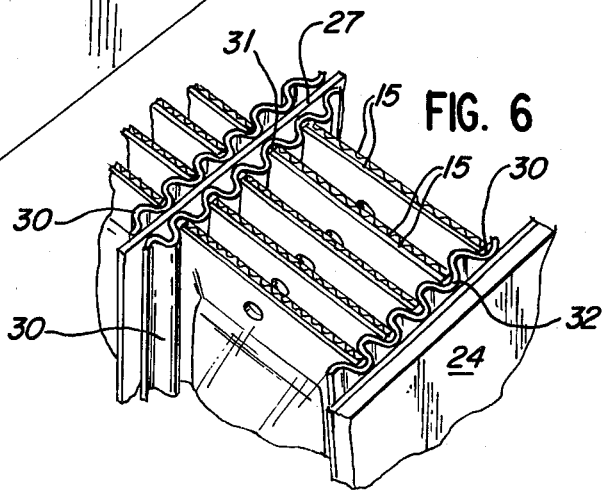
FIG. 6 is a fragmentary perspective view of a shipping carton or tray having track means along opposing interior surfaces thereof for stacking skin-packaged retort pouches therein.

Referring to FIG. 6, it will be seen that corrugated liners 30 have been provided to engage against the illustrated partition wall 27 and carton wall 24. The back-to-back pouches 15 have been seated in oppositely facing valleys 30, 31, 32 of such liners 30. In this manner, the valleys 30, 31, 32 provide tracks for a pair of back-to-back packages 15. The use of such corrugated liners or other types of track members for this purpose is not intended as the invention of the applicants herein. However, the resulting skin-packaged retort pouch 15 is especially suitable for storage in shipping cartons and trays having such track means for holding packages 15 in an upright stored position.

Figure 7:
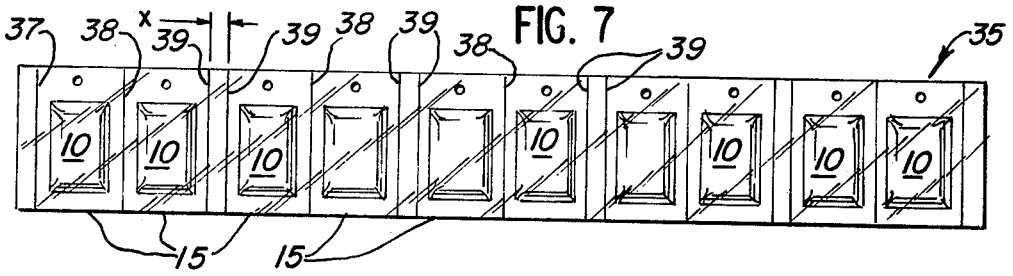
FIG. 7 is a planar view of an elongated strip assembly of skin-packaged retort pouches according to the invention.
Figure 8:
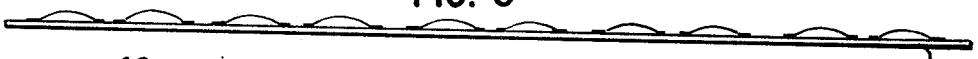
FIG. 8 is a side elevational view of the elongated strip assembly of FIG. 7.
Figure 9:
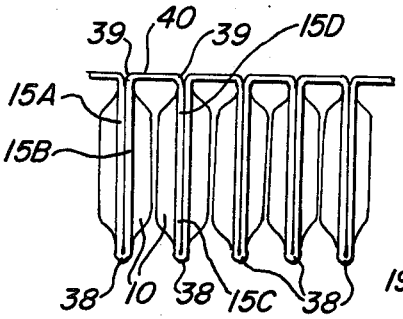
FIG. 9 is a fragmentary side elevational view of a portion of the strip assembly of FIG. 7 folded in accordance with the invention.

Referring to FIG. 7, an elongated strip assembly of skin-packaged retort pouches embodying the invention is designated generally by reference character 35. The assembly 35 is comprised of an elongated, rectilinear strip or sheet of similar paperboard 36 which functions as the substrate for the pouch 10 skin-packaged thereon. As seen in FIG. 7, individual pouches 10 have been immobilized along the length of the strip 36 in a conventional manner by means of a suitable plastic film 37. A series of score or fold lines are provided in the substrate 36 extending across the width of the strip 36. Such score or fold lines are designated 38 and 39, respectively. The fold lines 39 are located at the interior terminal extremities of a pair of packages 15 connected along a fold line 38. When the strip 35 is folded along fold lines 38 and 39, respectively, a pair of packages 15A and 15B will be back-to-back, as seen in FIG. 9. There will be a narrow segment 40 of the substrate 36 between fold lines 39 so that the pouch 10 of package 15B will face and contact the pouch 10 which itself will be back-to-back with the package 15D. This alternating sequence of back-to-back packages and packages having facing pouches 10 is derived from such selected location of the score lines 38 and 39.

Figure 10:
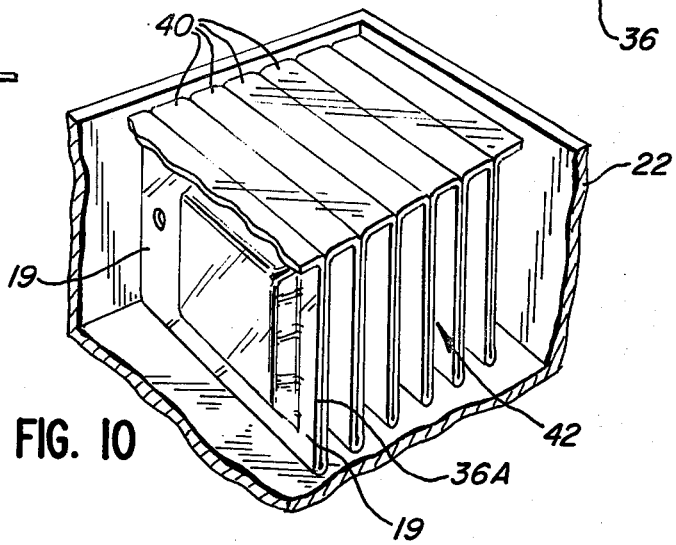
FIG. 10 is a fragmentary perspective view of a folded strip assembly of FIG. 7 stacked in a shipping carton or tray in accordance with the invention, the shipping carton or tray being broken away to show details of such stacking.

Referring to FIG. 10, the folded assembly of FIG. 9 is shown in a stacked condition in the partial illustration of a carton or tray 22. It will be noted how the wide segments 40 at one end of the folded assembly 42 also help to provide additional stacking strength and protection for the retort pouches 10 of said assembly 42. Again, as seen in FIG. 10, the retort pouch 10 is protected on all sides thereof by marginal flanges 19 of the substrate portion 36A of that package which derived from substrate 36 by such folding of the assembly 35.

Figure 11:
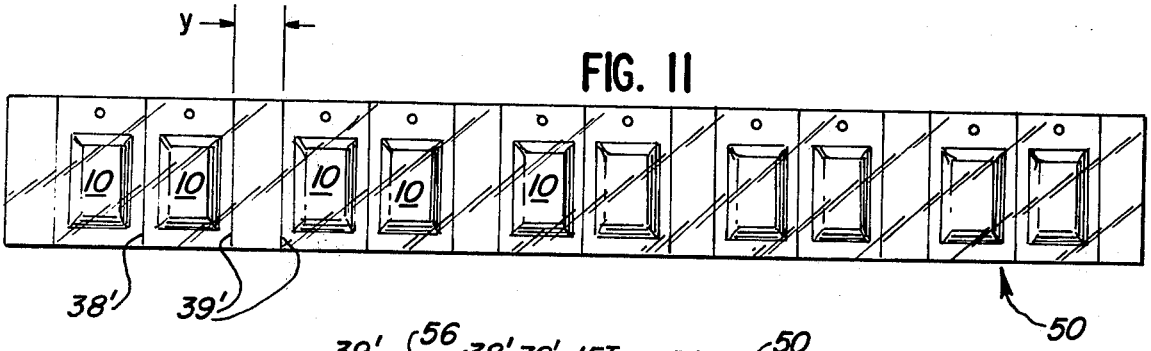
FIG. 11 is a planar view of a modified elongated strip assembly of skin-packaged retort pouches.
Figure 12:
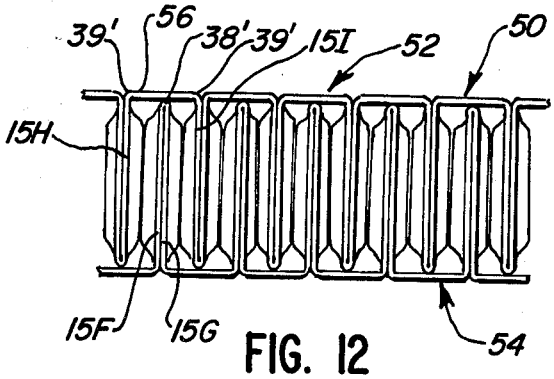
FIG. 12 is a fragmentary side elevational view of a pair of folded modified strip assemblies intermeshed for stacking in a shipping carton.

Referring to FIG. 11, a second embodiment for an elongated strip assembly of skin-packaged retort pouches is designated generally by the reference character 50. The assembly 50 is substantially identical to the assembly 36 with the exception of the spacing "y" between fold lines 39' as compared to the spacing designated "x" between fold lines 39 of assembly 35. The greater spacing "y" between fold lines 39' of assembly 50 enables a pair of folded assemblies 52 and 54 to be intermeshed as seen in FIG. 12. The segment 56 between fold lines 39' is sufficiently wide to accommodate a pair of folded packages 15F and 15G. The packages 15F and 15G are arranged back-to-back along a fold line 38'. Packages 15F and 15G are derived from the folded assembly 54. When an assembly 54 is intermeshed with an assembly 52, the assembly 52 will provide packages 15H and 15I which will engage packages 15F and 15G, respectively, as seen in FIG. 12. In this embodiment 50, the intermeshed assemblies 52 and 54 provide additional interior protection for the pouches 10, as can readily be appreciated from FIG. 12.

Conventional skin packaging equipment is available for making the strip assemblies 35 and 50, including selected scoring along lines. Likewise, the plastic film rigidifying and immobilizing the individual retort pouches 10 can be perforated on the substrate to permit severing of the individual skin packages from the assemblies 35 or 50 as desirable.

Referring to FIGS. 13, 14 and 15, there are illustrated modified embodiments of the package 15 designated respectively by the reference characters 15A, 15B and 15C. The packages 15A, 15B and 15C are identical to the package 15 with the exception of the substrate on which the pouch 11 thereof is skin-packaged. Accordingly, the substrate of each of the packages 15A, 15B and 15C is assigned the same reference character 16 but with the alphabetical character A, B or C as is appropriate to coincide with the package identification.

Referring to FIG. 13, the substrate member 15A has been elongated relative to the pouch 11 secured thereon by the film 17 so as to provide a planar extension 60 at opposite ends thereof. One such extension 60 is shown in phantom outline prior to folding thereof to provide a pair of flanges 61 and 62 connected along score or fold line 63. The flange 61 is connected along fold line 64 to the body portion of substrate 16A. It is return-bent to incline upwardly from the substrate 16A at an angle selected to assure that said flange 61 will also bear against the adjacent sealed joint 14 of the pouch and further assist in restraining inadvertent pouch movement.

The flange 62 also is return-bent to project outwardly of flange 61 and the pouch 11. The acute angle between the flanges 61 and 62 permits the flange 62 also to function as a cushioning means to absorb forces exerted toward the pouch 11. Thus, the flanges 61 and 62 cooperate both to further restrain the pouch 11 against movement relative to the substrate 16 and to absorb forces, i.e., as a cushion, exerted toward the pouch 11 during shipment in a container 22, for instance.

Referring to FIG. 14, there is another modified embodiment of the invention designated 15B. The package 15B is identical to package 15A except for size. In other words, the flange arrangement 61 and 62 in 15B is like that of 15A. It is just a different size package. Also, the flanges 61 and 62 may be considered to be along a pair of opposite sides of the package and not necessarily, opposite ends.

Referring to FIG. 15, another modified embodiment of the invention is designated generally 15C. Package 15C is similar to package 15A with exception of the cushioning and restraining flanges provided. The package 15C has a pair of triangulated flange formation 65 formed at each of the four corners of the package 15C. Each formation 65 is derived from an elongated planar segment 66 of the substrate 16C extending well beyond the pouch 10. The segment 66 is comprised of a right triangular section 67 hingedly connected along fold line 68 to the body of substrate 16 at one corner thereof and a second triangular section 69 connected along fold line 70 to section 67. It will be noted that fold line 70 extends partially along the hypotenuse edge 71 of the section 67.

The segment 66 is shown folded into the formation 65 in FIG. 15. A segment 67 is return bent to extend upwardly from the substrate 16C at an acute angle but it bears against film 17 and hence, pouch 11, and a sealed edge 14 of the pouch so as to assist in restricting movement of pouch 10 on substrate 16. The segment 69 also is return-bent to protrude outwardly from segment 67 at an acute angle to serve as a cushion member since it can move along the hinge line 70. As seen in FIG. 15, a formation 65 is provided at each corner of the package 15C.

Although not shown, the packages 15A, 15B and 15C can be further modified to eliminate the segments 62 and 69 and merely extend the length of the segments 61 and 67 to achieve the additional cushioning advantages for the package.

It is believed that the invention has been described and illustrated in sufficient detail to enable practice thereof by the person skilled in the art. Minor variations in structure or dimensions of the several parts thereof may occur without departing from the governing principles of the invention as set forth in the claims appended hereto.

What is claimed is:

1. A skin package comprising, in combination, a paperboard substrate member capable of permitting passage of air therethrough from opposite surfaces thereof, said member having a medial body portion and marginal edges spaced from said body portion, a product-laden retort or like pouch supported on said medial body portion inwardly of said marginal edges, said pouch formed of a pair of rectilinear sheets of fragile, flexible material thermally sealed together along the perimetric edges othereof, said product capable of generating hydraulic, wave-like forces impinging against said sealed edges internally of the pouch during handling of the package which are capable of rupturing said sealed edges, a plastic film means vacuum-drawn and laminated on said substrate tightly engaged over said pouch and said sealed edges for mounting and immobilizing said pouch on said medial portion, for reinforcing and pressing said sealed edges against said substrate member to prevent rupture of said sealed edges by internal generated forces, and for reducing the effect of such forces against interior surfaces of the pouch sufficient to prevent flex-cracking of the sheets, said member having planar portions extending beyond said sealed edges to provide stacking strength for the package when oriented vertically in a shipping carton.

2. A skin package as described in claim 1 in which said planar extending portions have flange means integral therewith return bent to engage said film at locations thereon overlying said sealed edges so as to additionally immobilize the pouch on the member and protect said sealed edges against rupture.

3. A skin package as described in claim 2 including second flange means connected to said first mentioned flange means and return bent to overly said first flange means at an outwardly directed acute angle thereto to define a cushioning means for said package.

4. A skin package as described in claim 3 in which said first and second flange means are provided along a pair of opposite marginal edges of the member.

5. A skin package as described in claim 3 in which said flange means are provided at corners of the member.

6. A skin package as described in claim 1 in which a plurality of like skin packages are provided with the associated substrate members being defined by a continuous strip of a paperboard substrate, said packages being arranged in pairs longitudinally spaced along said strip, a single foldable score line between the packages of each pair of packages and two longitudinally spaced foldable score lines between each pair of packages.

7. A skin package as described in claim 6 in which the continuous strip is foldable into a strip assembly having adjacent packages of each pair of packages with the substrate members engaged, the adjacent packages of adjoining pairs of packages having the pouches thereof in face-to-face relationship.

* * * * *